United States Patent [19]

Arntson

[11] Patent Number: 4,586,192

[45] Date of Patent: Apr. 29, 1986

[54] SOUNDSTAGE BOUNDARY EXPANSION SYSTEM

[75] Inventor: Lawrence E. Arntson, Aloha, Oreg.

[73] Assignees: Robert B. Welch, Milwaukie; David O. Johnson, Lake Oswego, both of Oreg. ; part interest to each

[21] Appl. No.: 574,346

[22] Filed: Jan. 27, 1984

[51] Int. Cl.[4] ..... H04R 5/00

[52] U.S. Cl. ..... 381/24; 381/1; 179/115.5 DV

[58] Field of Search ..... 381/1.24, 117, 71; 179/111 R, 115.5 DV

[56] References Cited

U.S. PATENT DOCUMENTS

| | | | |
|---|---|---|---|
| 2,205,365 | 6/1940 | Schwaen | 179/115.5 DV |
| 3,892,927 | 7/1975 | Lindenberg | 179/111 R |
| 4,160,882 | 7/1979 | Driver | 179/111 R |
| 4,308,423 | 12/1981 | Cotten | 381/1 |
| 4,309,570 | 1/1982 | Carver | 381/1 |
| 4,357,498 | 11/1982 | Tsuchiya et al. | 179/115.5 DV |
| 4,438,297 | 3/1984 | Kawamura | 179/115.5 DV |

*Primary Examiner*—Forester W. Isen
*Attorney, Agent, or Firm*—John P. Dellett

[57] ABSTRACT

A system for providing the effect of an extended soundstage comprises a pair of stereophonic loudspeakers, each having a movable or vibrational element driven by a pair of voice coils including a principal or main voice coil and an auxiliary or enhancement voice coil. The principal voice coil of each speaker is driven in a customary manner from one channel of a stereophonic amplifier, while the enhancement voice coil is driven in a reversed phase sense from the output of the opposite channel, and sound is effectively provided over an extended apparent source having dimensions beyond the spacing between the loudspeakers.

9 Claims, 9 Drawing Figures

SOUNDSTAGE BOUNDARY EXPANSION SYSTEM

BACKGROUND OF THE INVENTION

The present invention relates to a loudspeaker system and particularly to a loudspeaker system for providing an expanded soundstage and three dimensional effect within a given listening area.

In simplest terms, a stereophonic reproduction system employs plural microphones to pick up sounds emanating from various areas on a stage, and corresponding transducers or loudspeakers are driven separately to reproduce the sounds received at the various microphones. Of course, signals may be manipulated to varying degrees and a number of channels may be combined to provide essentially two output channels which are recorded for reproduction in a customary stereophonic loudspeaker system. The concept of providing realistic sound in this manner is valid in many respects because a person with normal hearing picks up sounds binaurally. However, speaker design, speaker location, room acoustics, and electronic circuitry are all critical factors in achieving the desired results. If speakers are placed farther apart to give the perception of a larger soundstage, a "hole" may become apparent between the two speakers, and sound will appear to emanate from the right and/or left loudspeaker. In addition adjacent walls will cause unwanted reaction to the sound waves and will tend to interfere with desired wave radiation patterns. On the other hand, if the speakers are placed too close together, the middle information will dominate and the soundstage will appear much narrower. Also, movement of the listener from the apex of an equal sided triangle formed by the speakers and himself will cause a perceived shift in the program material from one side of the soundstage to the other, i.e. deteriorating the stereophonic effect.

If two loudspeakers are fed "out of phase" with the same signal it is possible to achieve the illusion of sound originating to the left of both speakers or to the right of both speakers depending upon which speaker is out of phase from normal. The effect is not a particularly natural one. It would be desirable to provide a loudspeaker system presenting the illusion of sound emanating from an entire soundstage having dimensions beyond the distance between two loudspeakers, such as speakers 12 and 14 in FIG. 1, e.g. along the stage 10 between points 18 and 20 in FIG. 1.

One prior art approach to providing a broadened soundstage is illustrated in FIG. 2 wherein speaker 12 in FIG. 1 is replaced by a pair of speakers 26, 32 and speaker 14 is replaced by a pair of speakers 28, 30. The principal speakers 26 and 28 are driven from conventional stereo amplifier channels 22 and 24, but auxiliary or enhancement speakers 30 and 32 are driven in a reversed phase sense from the opposite channel. Enough wavefront subtraction is produced so that sound will appear to originate to the left and to the right of the group of speakers as well as therebetween, if the speakers aren't too far apart and if the auxiliary speakers 30 and 32 are operated at an amplitude level less than that of the main speakers 26 and 28. Unfortunately, the FIG. 2 approach has certain acoustical drawbacks including major shifts in perceived locations as well as cancellations of image, apparently due to phase anomalies which occur whenever the listener moves from a given spot, e.g. away from apex location 16 in FIG. 1. This phenomenon apparently takes place primarily because the extra speakers 30 and 32 have different points of radiation from those of the main speakers, even if located in the same enclosure or cabinet with the main speakers. Thus the ear, which is phase sensitive, picks up the time difference in the sound wave radiation pattern from each enclosure and renders the expanded soundstage system "believable" only at certain positions.

It is also possible to perform the function of the FIG. 2 system electronically, wherein single transducers or loudspeakers are substituted for the pairs 26, 32 and 38, 30. Thus, the lefthand speaker in a stereophonic system is driven from an electronic adder or summing point which receives both the output from the lefthand amplifier channel 22 and a reversed and attenuated output from the righthand channel 24. Unfortunately the subtraction or summation achieved is frequently not natural enough to provide a sound which the listener will perceive as coming from a broadened soundstage.

In spite of the various problems, the prior art approaches do give the listener some sensation of an expanded soundstage, and the systems are interesting and viable. They do suffer from lack of realism, particularly if the listener moves from the central location or apex indicated at 16 in FIG. 1.

Experiments using the technique of FIG. 2 have led to the conclusion that optimum results could be obtained if the two drivers, such as 26, 32, could occupy the same physical space in an enclosure and be of identical design and construction. This is an apparent impossibility.

SUMMARY OF THE INVENTION

In accordance with the present invention in a principal embodiment thereof a soundstage boundary expansion system for providing the effect of a sound source characterized by apparent sound directionality beyond the physical dimensions of the system includes a stereo amplifier, with first and second output channels, and first and second transducers or loudspeakers having movable elements which vibrate in response to the respective output channels. In addition, the same physically movable elements are responsive in a reversed phase sense to the outputs of the opposite output channels. That is, the movable vibrational transducing element of each loudspeaker is driven in a first phase sense in a normal fashion from an amplifier channel output, and the movable element is also driven in a reversed phase sense from the opposite amplifier channel output.

In a particular embodiment a loudspeaker in accordance with the present invention is provided with a pair of voice coils disposed in separate air gaps of the loudspeaker magnetic circuit, with each voice coil being attached to the same loudspeaker cone. The respective voice coils are driven from opposite channel outputs in a reversed phase sense.

In appears the response of a given transducer movable element, physically driven from the two sources, better simulates the response of the human ear drum, which, after all, is itself a physically movable diaphragm driven by sound information originating from various directions and which is highly sensitive to the sound information for ascertaining the direction from which the sound is coming. Each loudspeaker in the system according to the present invention more clearly convinces the ear of the person with binaural hearing that sound is legitimately produced from a location outside the soundstage boundaries represented between the two speakers, and without requiring the speakers be placed so far apart as to produce a "hole" or void between the loudspeakers. The loudspeakers can even be placed along a relatively short wall or in a relatively small room and still provide the effect of a broadened soundstage which may in fact be larger than the room in which the loudspeakers are located. The listener is not confined to a small listening area or apex to achieve the impression of the large soundstage, and will also perceive a depth to the soundstage so that different instruments appear to reside at forward and rearward locations on the stage as well as at extended left and right locations.

It is accordingly an object of the present invention to provide an improved soundstage boundary expansion system which is more effective in providing the illusion of sound beyond the physical dimensions of the system.

It is another object of the present invention to provide an improved soundstage boundary expansion system for providing the effect of a sound source characterized by apparent sound directionality beyond the physical dimensions of the system, and wherein the effect is perceived over a relatively wide area rather than at a specific apex location or region near an apex location.

It is another object of the present invention to provide an improved soundstage boundary expansion system that is more economical to produce than systems heretofore proposed.

It is another object of the present invention to provide an improved soundstage boundary expansion system which retains phase coherency throughout a broad listening area.

It if a further object of the present invention to provide an improved soundstage boundary expansion system that permits greater flexibility in the placement of loudspeaker enclosures.

It is another object of the present invention to provide an improved soundstage boundary expansion system which provides a three dimensional effect and gives the illusion of instrument placement in the total soundstage.

It is a further object of the present invention to provide an improved soundstage boundary expansion system without incurring undesirable sound wave reflections from adjacent walls or other surfaces.

The subject matter which I regard as my invention is particularly pointed out and distinctly claimed in the concluding portion of the specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is a diagram illustrating placement of speakers relative to a listener, and desired soundstage expansion, FIG. 2 illustrates a prior art system, FIG. 3 is a longitudinal cross sectional view of a loudspeaker according to an expansion system of the present invention, FIG. 4 is a schematic diagram showing loudspeaker interconnection in the system of the present invention, FIG. 5 is a front view, partially broken away, of a second loudspeaker suitable for the system of the present invention, FIG. 6 is a horizontal cross section of the FIG. 5 speaker, FIG. 7 is a perspective view of a third loudspeaker suitable for the system of the present invention, FIG. 8 is a horizontal cross section of the FIG. 7 speaker, and FIG. 9 is a front view, partially broken away, of a fourth loudspeaker suitable for the system of the present invention.

DETAILED DESCRIPTION

Figure 1:
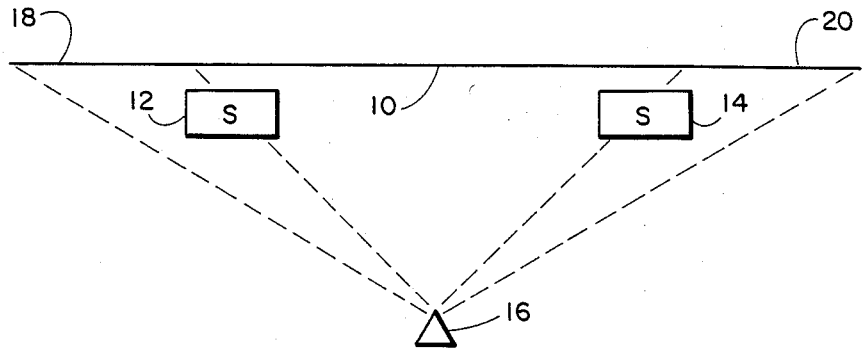

Referring to the drawings and particularly to FIG. 1, line 10 indicates a soundstage or apparent soundstage represented to the listener by stereophonic speakers 12 and 14, wherein 12 represents the lefthand speaker and 14 represents the righthand speaker. The position of the listener is indicated in 16. Thus the listener or audience is typically located in front of the speakers, at a location approximately equidistant from each speaker. Depending upon the distance of the listener to the front of the line of speakers, the listener will receive an impression of directionality or location of sound along soundstage 10, but in prior art systems the limit of the apparent soundstage is ordinarily the distance between the two speakers 12 and 14. A uniform soundstage may not be presented to the listener in prior art systems, but rather he may perceive a "hole" or void directly between the speakers. The system according to the present invention not only provides a uniform soundstage, but also provides the impression of sounds emanating to the left and/or to the right of both speakers, thus giving an impression of a wide soundstage, e.g. between more widely separated points 18 and 20. The effect according to the present invention is not limited to listening location 16.

Figure 2:
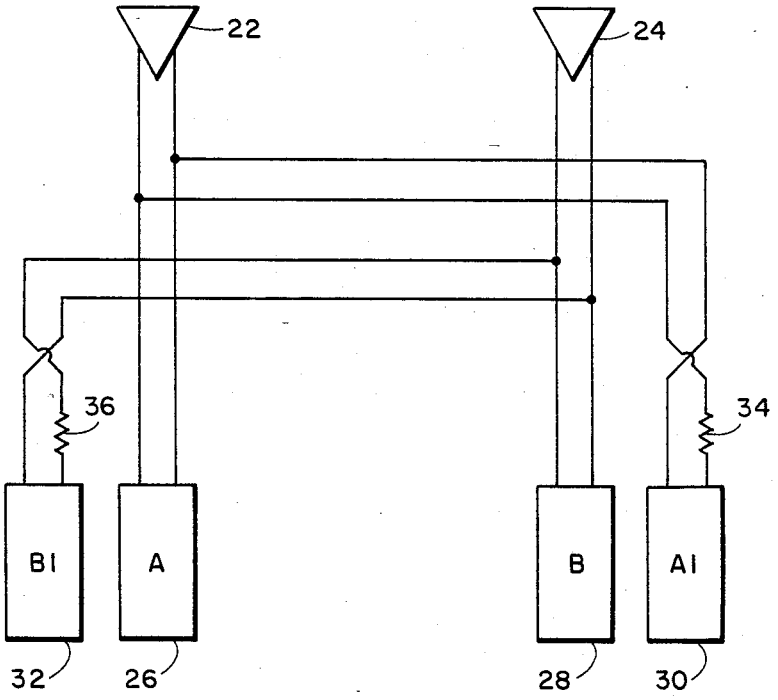
FIG. 2 PRIOR ART

As mentioned hereinbefore, FIG. 2 is a representation of a prior art system including a pair of stereo amplifiers or channels 22 and 24 driving principal speakers A and B (numbered 26 and 28). In addition to the principal speaker 26, amplifier channel 22 drives an auxiliary speaker A1 (numbered 30) physically positioned proximate B speaker 28. Also, amplifier channel 24 drives an auxiliary speaker B1 (numbered 32) which is physically located proximate A speaker 26. The leads are reversed to both auxiliary speakers 30 and 32 so they are fed out of phase with their respective principal speakers, and the leads to each auxiliary speaker are suitably provided with resistance (e.g. resistors 34 and 36) for attenuating the signal to the auxiliary speakers. Phase reversal has the effect of placing the apparent sound either entirely to the left or entirely to right of both sets of speakers, while the resistances 34 and 36 attenuate the signals to the auxiliary speakers such that cancellation does not occur in between the speakers as would present an apparent sound void. There may also be delay provided between each of the amplifier channels and each of the auxiliary speakers. While the system of FIG. 2 is somewhat effective in providing a wide soundstage, as hereinbefore mentioned, the system is very sensitive with regard to the location where the effect is perceived. The listener at central position 16 (in FIG. 1) will lose the impression of a wide soundstage if he moves at all from his central position. The result is believed to be caused by the phase differences between physically separate but adjacent speakers such as, for example, speakers 26 and 32 in FIG. 2. If the speakers 26 and 32 were located at exactly the same point, then the desired effect would be produced over a wide area. The ear of the listener is apparently sufficiently sensitive to the phase differential resulting from the necessary spacing between the actual sound-producing means in speakers 26 and 32 so that only a limited range of listener positions will provide the desired soundstage effect.

Figure 3:
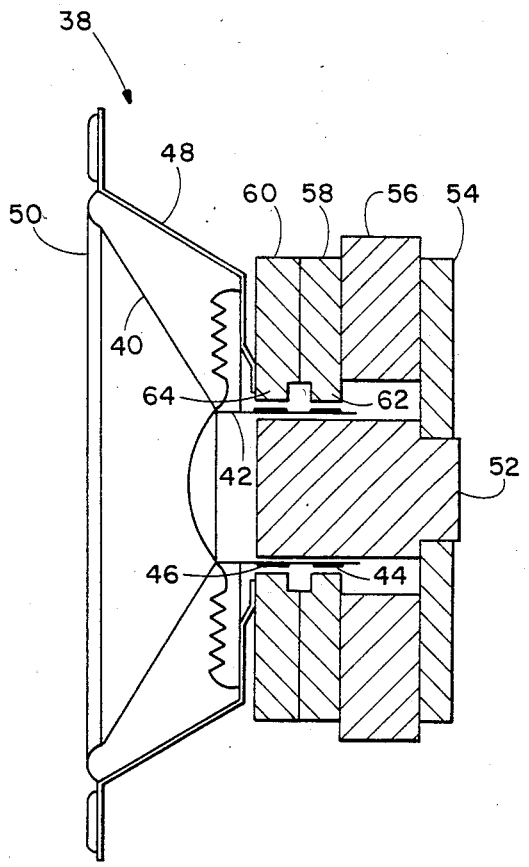

In accordance with the present invention, a soundstage expansion system employs transducers or loudspeakers with physically movable elements that are driven in response not only to a main or principal amplifier channel output, but also from a reversed-phase amplifier output from the opposite channel. In this manner, there is no phase difference between generated sounds as was the case with speakers 26 and 32 in FIG. 2, but rather the sounds appear to and do originate from the same point. Referring specifically to FIG. 3, a transducer or loudspeaker 38 according to the present invention is provided with a physically movable element comprising a diaphragm or cone 40 carrying a bobbin 42 around which are wound voice coils 44 and 46. The voice coil 44 is driven by a given channel amplifier, say the left channel amplifier of a stereophonic system, while the voice coil 46 is driven from the reversed phase output of the opposite channel amplifier, as hereinafter more fully described.

The loudspeaker further includes a basket or frame 48 which supports cone 40 therewithin by means of flexible surround 50. Attached to the cone is a bobbin 42 located around cylindrical pole piece 52 which extends forwardly from a bottom plate 54. Plate 54 also carries annular magnet 56. On the forward side of the magnet, i.e. toward the basket 48, there is a lower top plate 58 which is annular in construction and an upper top plate 60 which is also annular in construction. The latter top plate is secured to the basket 48, with the top plates being supported between the basket and magnet.

Each of the top plates includes an annular, inwardly facing, separate end piece (numbered 62 and 64 respectively) disposed in juxtaposition with the central pole piece 52 to define a pair of separate air gaps. Magnetic circuits are completed to supply magnetic flux across air gaps. It will be noted voice coils 44 and 46 are respectively located by bobbin 42 in separate air gaps whereby current in the respective voice coils reacts with the magnetic flux across the air gaps to produce movement of the speaker cone.

Figure 4:
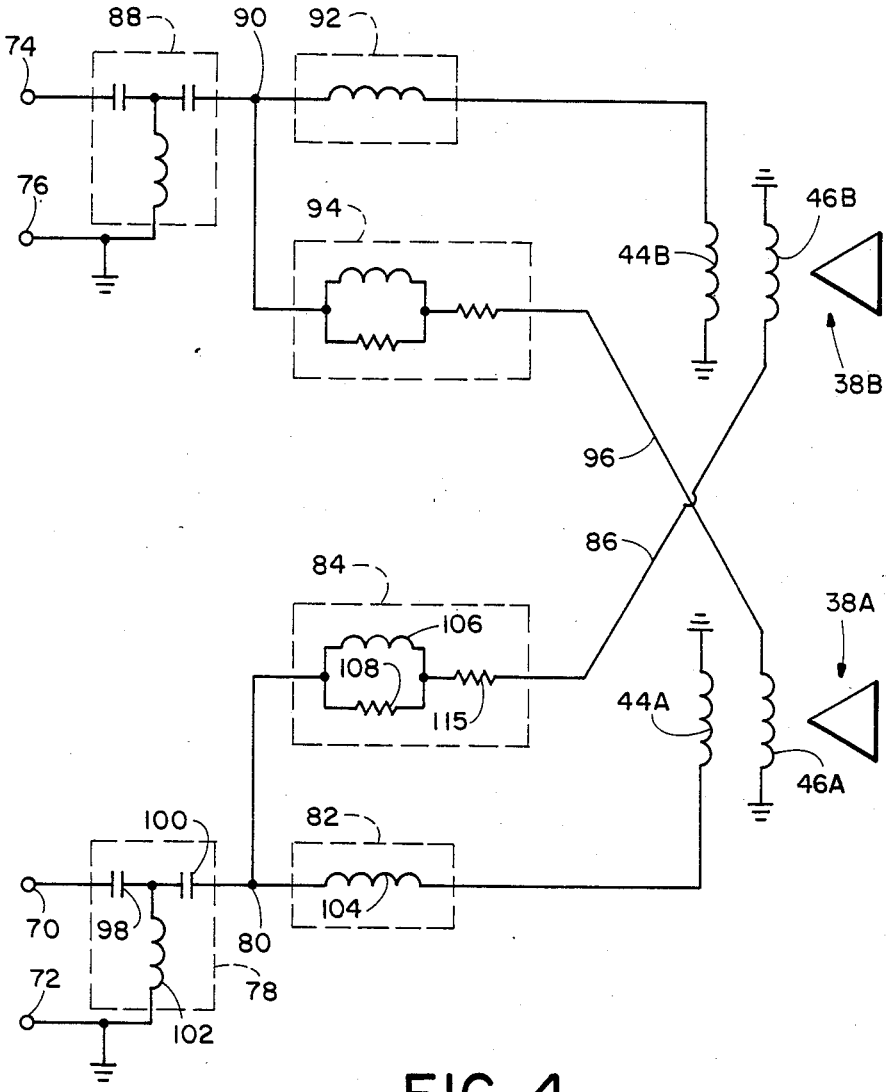

Referring now to FIG. 4, illustrating schematically the electrical connections of the system according to the present invention, a pair of left and right speakers 38A and 38B are respectively constructed in the manner illustrated in FIG. 3, i.e. each has a main or principal voice coil 44 and an enhancement voice coil 46. Connections 70 and 72, comprising the output leads of a left channel amplifier, are connected in the manner shown with terminal 72 grounded and terminal 70 coupled through high pass filter 78 to a terminal 80. Terminal 80 is connected by means of low pass filter 82 to one terminal of principal voice coil 44A of lefthand speaker 38A, while the remaining terminal of such voice coil is grounded.

Terminal 80 is also connected to an input of low pass filter and attenuator 84 having an output lead 86 which is cross-connected to the auxiliary or enhancement voice coil 48B of the righthand speaker 38B. It will be observed that voice coil 46B has its connections reversed from those of the principal voice coil 44B on the same speaker, i.e. enhancement voice coil 46B is fed in an inverted phase relation to voice coil 44B and also in inverted phase relation to voice coil 44A of the lefthand speaker.

Similarly, terminals 74 and 76, comprising the output terminals of the righthand amplifier channel, are connected by way of high pass filter 88 to a terminal 90 which is in turn coupled through low pass filter 92 to the principal or main voice coil 44B of righthand speaker 38B and the same terminal 90 is also coupled by way of low pass filter and attenuation circuit 94 to lead 96 which is cross connected to the enhancement voice coil 46A of left hand speaker 38A. It will be observed that enhancement voice coil 46A is driven 180 degrees out of phase with respect to principal voice coil 44A of the same speaker and with respect to principal voice coil 44B of the righthand speaker. Although the system according to the present invention may provide the only sound output for a sound system, it is contemplated that speakers 38A and 38B respectively comprise midrange audio transducers for a stereophonic sound system, while left and right woofers and tweeters will also be included in the same enclosures with speakers 38A and 38B.

Low pass filter 78, suitably comprising serially connected capacitors 98 and 100 and shunt inductance 102, is designed in a conventional manner to have a −3 dB attenuation point at a predetermined frequency between 100 and 700Hz. More particularly, the attenuation point is advantageously between 100 and 300 Hz, and in one example 100 Hz has been found suitable. Lower frequencies may be adequately presented by the woofer system and moreover are suitably excluded from the system according to the present invention to avoid cancellation of low frequencies or a "doppler" like effect. Also undesired resonance is avoided.

The low pass filter 82 leading to the main or principal voice coil suitably has a −3 dB attenuation point at about 3,000 Hz assuming a tweeter system is present for the high frequencies. Of course, if no such tweeter system is employed, the filter 82 may be adjusted. Filter 82 is illustrated as comprising simply a series inductance 104, but other filter circuits may be substituted therefor.

The low pass filter and attenuation circuit 84 is illustrated as comprising a parallel combination of inductance 106 and resistor 108, such combination being connected in series with resistor 115, and has the combined attributes of attenuation in accordance with the resistance of the resistor 115, a small amount of delay, and low pass filtering having a −3 dB attenuation point at a frequency between 600 and 3,000 Hz. The attenuation of the low pass filter represented by inductance 106 and resistor 108 is suitably designed such that the signal therethrough is attenuated at 700Hz and above with an approximate slope of 3 dB per octave, with the response of the enhancement speaker coil 46B being "contoured". Alternatively, the attenuation point can be at approximately 900 Hz, this being the frequency, according to Weiners's defraction measurements, at which decay of high frequency wave patterns begin as they encounter the shape of the human face, passing therearound from one side of the face to the opposite ear. Consequently, the voice coil 46B is provided with a rolloff simulating the frequency contour experienced by the listener's right ear as he hears sounds approaching from the left side of his head. The result of this contoured response is a more lifelike and realistic production of sounds appearing to originate from the left of the listener.

The attenuation provided by resistor 115 decreases the amplitude of the drive to the enhancement coil 46B to avoid the appearance of a hole or a void in front of the listener between the two speakers as may be the case with no attenuation. The amount of attenuation will depend upon the placement of the speakers to some extent.

The component elements of filter circuits 88, 92 and 94 and their purpose correspond to those of circuits 78, 82 and 84 and need not be discussed separately. It will be obvious from the above discussion that the operation of righthand speaker 38B is substantially the counterpart of the lefthand speaker.

With the speaker construction and circuit illustrated, an apparent wide soundstage is presented to the listener, with sounds appearing to originate beyond the boundaries of the speakers such as 12 and 14, i.e. from a wider soundstage for example between points 18 and 20 in FIG. 1. The sounds may even appear to originate beyond the walls of a room in which the speakers are positioned, and the speakers 12 and 14 need not be spaced widely apart to achieve this effect. Thus the speakers can be placed against the "short wall" of a room while still producing a pronounced wide soundstage effect. Morevoer, the effect is not highly dependent upon position of the listener. The listener need not be located at position 16, at the apex of the system, but can be nearly anywhere in front of the two loudspeakers while still receiving the impression of the wide soundstage. The effect of the wide soundstage while moving about the room is more pronounced than for either the prior art electronic mixing system, or the prior art dual speaker system as illustrated in FIG. 2.

The dual speaker system of FIG. 2, where the main enhancement speakers are physically separated to some degree even though in the same enclosure, apparently produces phase effects which are different as the listener moves and restrict the wide soundstage result to the location of the listener at point 16 in FIG. 1, or at least in close proximity thereto. The phase effects change as the person moves around the room listening to the prior art system, but do not change with respect to the system according to the present invention. As also explained, the wide soundstage effect is also improved as compared with the prior art electronic mixing system or the electronic equivalent of the system of FIG. 2 wherein the signals illustrated in FIG. 2 as applied to speakers or drivers 26 and 32 (or 28 and 30) are electronically summed and applied to the same driver. It is theorized that the summation (or subtraction) of sounds achieved in the electronic mixing system of the prior art produces a type of cross talk or modulation (or absence thereof) not as comparable with the response of the human ear as is the case with the present system. In the system according to the present invention, the two separate drive signals are applied to a single diaphragm in a given speaker or transducer. Thus, referring to FIGS. 3 and 4, a single diaphragm 40 is driven by voice coils 44 and 46 in each case. The response of the diaphragm is apparently not too unlike that of the human eardrum when encountering a pair of sounds, for the person with binaural hearing. In the dual voice coil drive illustrated for the present invention there is in fact a single diaphragm or vibrating speaker cone 40 for each of the left and right speakers, and therefore the left and right sounds originate from specified left and right points but have the effect of providing natural sound to the left and right ears respectively. In addition to providing a wide soundstage effect, the system according to the present invention is also perceived by the listener as producing a three dimensional effect, wherein the listener imagines he can place the instruments of an orchestra at different locations in front of him, depthwise as well as transversely across the soundstage.

The loudspeaker according to the present invention advantageously employs two voice coils 44 and 46 in two separate air gaps as herein described. However, it is also within the scope of the present invention to provide a pair of voice coils located on a single diaphragm of a conventional speaker, e.g. with the voice coils being bifilar wound or wound adjacently as understood by those skilled in the art. The construction as illustrated in FIG. 3 is preferred since when both voice coils are located in the same gap (bifilar wound), each voice coil tends to see the gap as being too large. The system then becomes somewhat less efficient or lossy. But, not only is the illustrated dual voice coil system according to the present invention more efficient, it also provides a more striking sound effect than is the case with the bifilar winding. With a bifilar winding there is apparently too much coupling (i.e. transformer coupling) or a chance for more interaction between the coils with the overall result being a summation electronically of the main and enhancement signals in a manner similar to the electronic summation system of the prior art. There seems to be not only too much cancellation, but dampening of the dynamic range when the coils are bifilar wound. The result according to the present invention is one of much more pronounced realism and ability to perceive the effect over a greater area in front of the speakers when the double air gap, double voice coil construction as illustrated in FIG. 3 is employed. However, as indicated, the bifilar winding arrangement is of some advantage and to a degree provides the result of the present invention.

Figure 5:
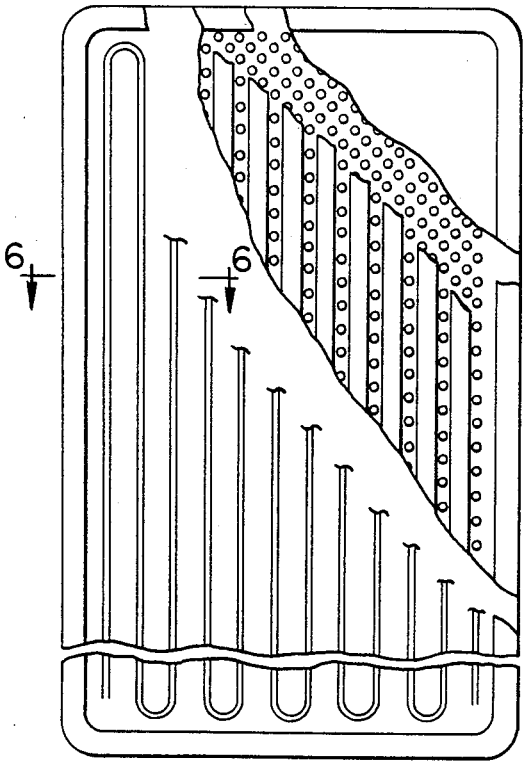
Figure 6:
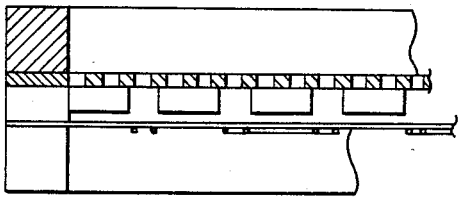

FIGS. 5 and 6 illustrate a planar type speaker which may be employed with the system according to the present invention. A tri-laminate frame 110 includes a rear border laminate 112, a central laminate 114, and a forward border laminate 116. Between laminates 112 and 114 is located at perforated aluminum plate 118 carrying a plurality of strip magnets 120. In this illustration, the strip magnets are disposed in a vertical direction and parallel to one another. Between laminates 114 and 116 there is positioned a Mylar diaphragm 122, the vibratory part of the speaker, which carries bifilar wound voice coils 124 and 126. The two voice coils are connected in the same manner as coils 44A and 46A in FIG. 4. Of course, a second speaker of the planar type would then be utilized for the remaining channel.

Figure 7:
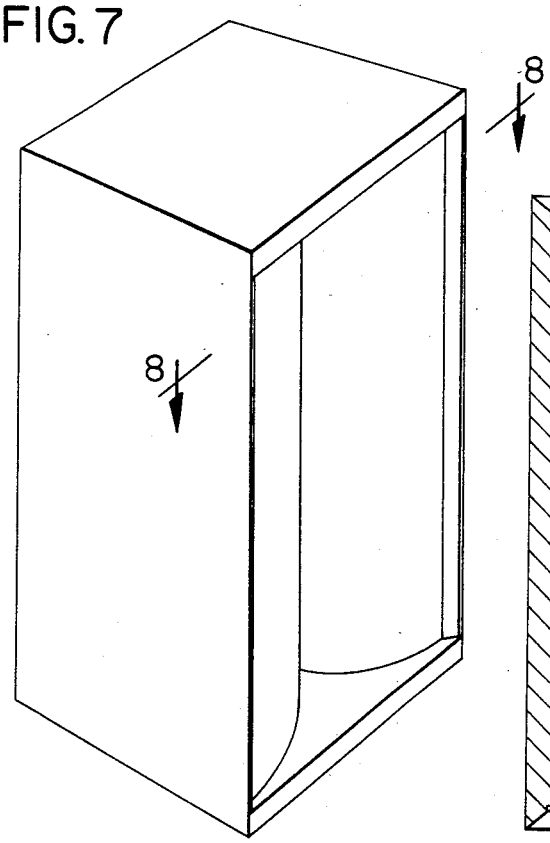
Figure 8:
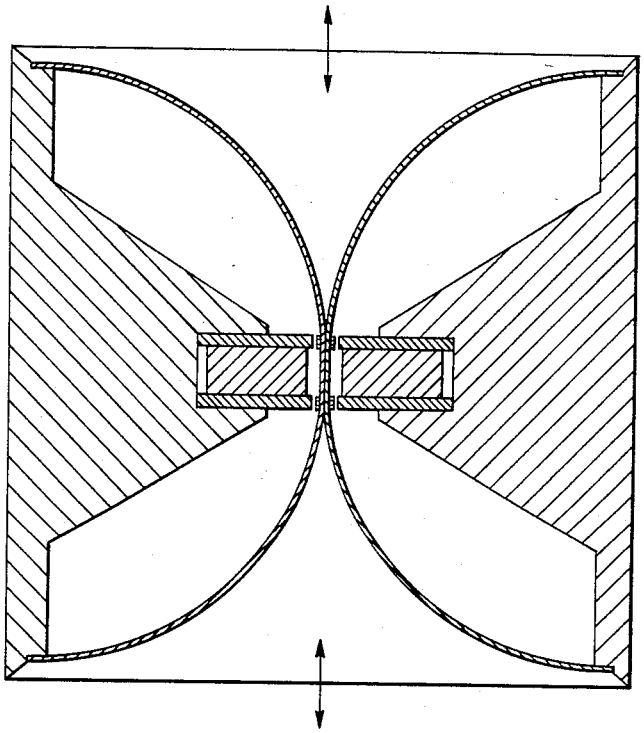

A double diaphragm speaker, which may be employed in conjunction with the present invention, is illustrated in FIGS. 7 and 8. A pair of semi-cylindrical diaphragms 128, suitably formed of Mylar, are respectively supported by halves 130 and 132 of a plastic frame. The semi-cylindrical diaphragms are glued or otherwise joined together centrally of the device, and first and second voice coils 134 and 136 are secured on opposite sides of the double thickness of Mylar where the diaphragms are joined. Each voice coil suitably comprises a multi-turn flat loop which is glued or otherwise secured to the double diaphragm.

Magnets 138 and 140 of the FIGS. 7 and 8 embodiment are supported or sandwiched between gap plates 142 and 144 respectively, and the gap plates are in turn received in apertures in the inwardly extending, somewhat pyramidal shaped portions 146 and 148 of the plastic frame so as to position the gap plates adjacent sides of the voice coils. Gaps formed between opposed ends of the gap plates thus receive sides of the voice coils causing the voice coils to be linked by magnetic flux from the magnets 138 and 140. Movement of the diaphragms, when the voice coils are energized in the manner of coils 44A and 46A and FIG. 4, is primarily in the direction of arrow 150, i.e., perpendicular to the long sides of the gap plates.

Figure 9:
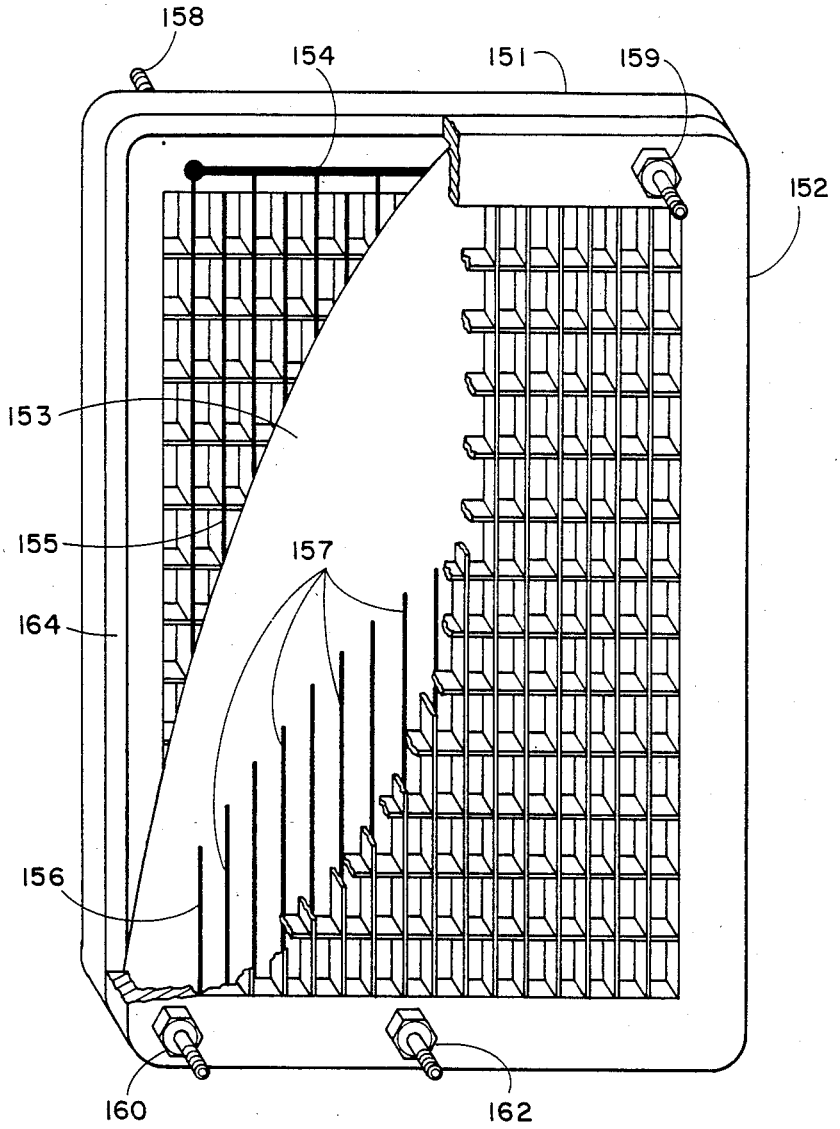

FIG. 9 illustrates an electrostatic type speaker which may be employed with the system according to the present invention. First and second panel frame members 151 and 152 enclose a conductive film diaphragm 153 which is engaged between peripheral flanges 164 of the panel frame members. Each of the panel frame members has a grid structure which is recessed away from the conductive film diaphragm, wherein panel frame member 151 is provided with a principal signal polarizing conductive grid 154 comprising spaced interconnected vertical disposed adjacent but spaced from diaphragm 153 on the opposite side thereof.

In between the conductors of conductive grid 154 on panel frame member 151 are disposed a plurality of parallel interconnected conductors comprising an enhancement signal polarizing conductive grid 155. On panel frame member 152 between the conductors of polarizing conductive grid 156 are located parallel interconnected conductors comprising an enhancement signal polarizing conductive grid 157.

In the illustrated construction, terminal 162 connects to conductive film diaphragm 153 while terminal 158 connects to conductive grid 154, terminal 160 connects to conductive grid 156, and terminal 159 connects to conductive grid 157. Another terminal (not shown) is connected to conductive grid 155.

The electrostatic speaker operates in a conventional manner for this type of speaker with respect to conductive grids 154 and 156 which are driven from a principal amplifier output. However, the enhancement polarizing conductive grids 155 and 157 are driven from the opposite channel in a reverse phase sense. A second electrostatic speaker of this type would also be utilized.

It will be seen that a number of different speaker constructions are possible according to the present invention, each employing plural voice coils so that each speaker is provided with principal and enhancement means for operating the same vibrational member or diaphragm.

While I have shown and described plural embodiments of my invention, it will be apparent to those skilled in the art that many other changes and modifications may be made without departing from my invention in its broader aspects. I therefore intend the appended claims to cover all such changes and modifications as fall within the true spirit and scope of my invention.

I claim:

1. A soundstage boundary expansion system for providing the effect of a sound source characterized by apparent sound directionality beyond the physical dimensions of the system, said system comprising:

an amplifier with first and second channel outputs respectively representing sound information intended to give the impression of originating from different directions, first and second sound transducers positionable at spaced locations and responsive to said first and second channel outputs of said amplifier, the first transducer having a physically movable element and first means for causing said physically movable element of said first transducer to vibrate in a first phase sense in response to the first amplifier channel output, and the second transducer having a physically movable element and second means for causing said physically movable element of said second transducer to vibrate in a first phase sense in response to the second amplifier channel output, said first transducer having means distinct from said first means for separately physically driving said physically movable element of the first transducer in proportion to said second amplifier channel output but in a reversed phase sense, and said second transducer having means distinct from said second means for separately physically driving said physically movable element of the second transducer in proportion to said first amplifier channel output but in a reversed phase sense.

2. The system according to claim 1 wherein said first and second means comprise main driving coils and wherein a said means for separately driving comprises an enhancement driving coil for substantially independently vibrating the corresponding movable element, the driving coils for a given physically movable element being energized in response to the first and second amplifier channel outputs.

3. The system according to claim 2 wherein each transducer comprises a loudspeaker and said driving coils comprise voice coils associated in driving relation with the diaphragm of the same loudspeaker.

4. The system according to claim 3 wherein said pair of voice coils are bifilar wound on the same loudspeaker cone bobbin.

5. The system according to claim 3 wherein a said loudspeaker includes a magnetic circuit adapted to produce magnetic flux, said magnetic circuit having a pair of air gaps, said pair of voice coils being respectively positioned in separate air gaps in said magnetic circuit in linking relation to said magnetic flux.

6. The system according to claim 5 wherein said magnetic circuit includes a central pole piece and a pair of top plates radially spaced from said central pole piece to define said separate air gaps, said loudspeaker including a bobbin attached to the diaphragm of said loudspeaker and extending between said central pole piece and said pair of top plates, with one of said voice coils being located on said bobbin in each air gap.

7. The system according to claim 3 wherein the diaphragm of said loudspeaker is substantially planar and said voice coils are bilifar wound in a circuitous path on said diaphragm.

8. The system according to claim 3 wherein said loudspeaker includes a second diaphragm joined to the first diaphragm, and having a common diaphragm area where the diaphragms are joined, said voice coils being attached to said common area, and a magnetic circuit adjacent said common area adapted to provide magnetic flux linking said voice coils.

9. The system according to claim 1 wherein the movable element of each said transducer is substantially planar and conductive, said first and second means comprising main electrostatic elements and wherein a said means for separately driving comprises enhancement electrostatic elements for substantially independently vibrating the corresponding movable element, the electrostatic elements for a given transducer being driven in response to the first and second amplifier channel outputs.

* * * * *

UNITED STATES PATENT AND TRADEMARK OFFICE

CERTIFICATE OF CORRECTION

PATENT NO. : 4,586,192

DATED : April 29, 1986

INVENTOR(S) : Lawrence E.Arntson

It is certified that error appears in the above-identified patent and that said Letters Patent is hereby corrected as shown below:

Column 5, line 66, "48B" should be --46B--.

Column 7, line 27, "Morevoer" should be --Moreover--.

Column 8, line 45, "at" should be --a--.

Column 9, line 22, between "vertical" and "disposed" insert --conductors--.

Signed and Sealed this

Twenty-eighth Day of October, 1986

[SEAL]

*Attest:*

DONALD J. QUIGG

*Attesting Officer*

*Commissioner of Patents and Trademarks*